US006937698B2

(12) United States Patent
Marshall

(10) Patent No.: US 6,937,698 B2
(45) Date of Patent: Aug. 30, 2005

(54) X-RAY GENERATING APPARATUS HAVING AN EMITTER FORMED ON A SEMICONDUCTOR STRUCTURE

(75) Inventor: Daniel R. Marshall, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 15 days.

(21) Appl. No.: 10/727,768

(22) Filed: Dec. 4, 2003

(65) Prior Publication Data

US 2005/0123095 A1 Jun. 9, 2005

(51) Int. Cl.[7] ..... H01I 35/00
(52) U.S. Cl. ..... 378/122; 378/136
(58) Field of Search ..... 378/119, 122, 378/136, 137, 138; 313/499

(56) References Cited

U.S. PATENT DOCUMENTS

| | | | | |
|---|---|---|---|---|
| 6,201,257 | B1 | 3/2001 | Stettner et al. | |
| 6,333,968 | B1 * | 12/2001 | Whitlock et al. | 378/136 |
| 6,558,968 | B1 | 5/2003 | Ramamoorthi et al. | |
| 6,577,058 | B2 | 6/2003 | Ossipov et al. | |
| 6,607,415 | B2 | 8/2003 | Dunfield et al. | |
| 6,617,597 | B2 | 9/2003 | Hilton | |

* cited by examiner

*Primary Examiner*—Edward J. Glick
*Assistant Examiner*—Hoon Song

(57) ABSTRACT

An X-ray generating apparatus comprises a semiconductor structure, an emitter formed on the semiconductor structure, with the emitter to emit electrons. The apparatus further comprises an element to generate X-rays in response to impact by the electrons on the element.

36 Claims, 3 Drawing Sheets

X-RAY GENERATING APPARATUS HAVING AN EMITTER FORMED ON A SEMICONDUCTOR STRUCTURE

BACKGROUND

X-rays are used in a number of different applications, such as medical diagnosis and treatment, inspection of parts to find hidden defects, screening of baggage and other items at sensitive areas (such as airports), and studying of very small particles.

An X-ray source typically includes an X-ray tube in which electrons are emitted from a thermionic cathode. The emitted electrons are accelerated by a large potential difference so that the electrons impact an anode. The electrons bombard the anode with sufficient energy to displace inner, more tightly bonded electrons from atoms in the anode. When these excited atoms return to their ground state, they emit short wavelength electromagnetic radiation that is known as X-rays. Conventional X-ray sources that include X-ray tubes tend to be relatively large in size, which may constrain the manner in which such X-ray sources can be used.

Particle accelerators, such as linear accelerators, are sometimes used as X-ray sources for generating relatively high-energy X-rays. However, such particle accelerators tend to be relatively expensive, and thus are not widely used.

DETAILED DESCRIPTION

Figure 1:
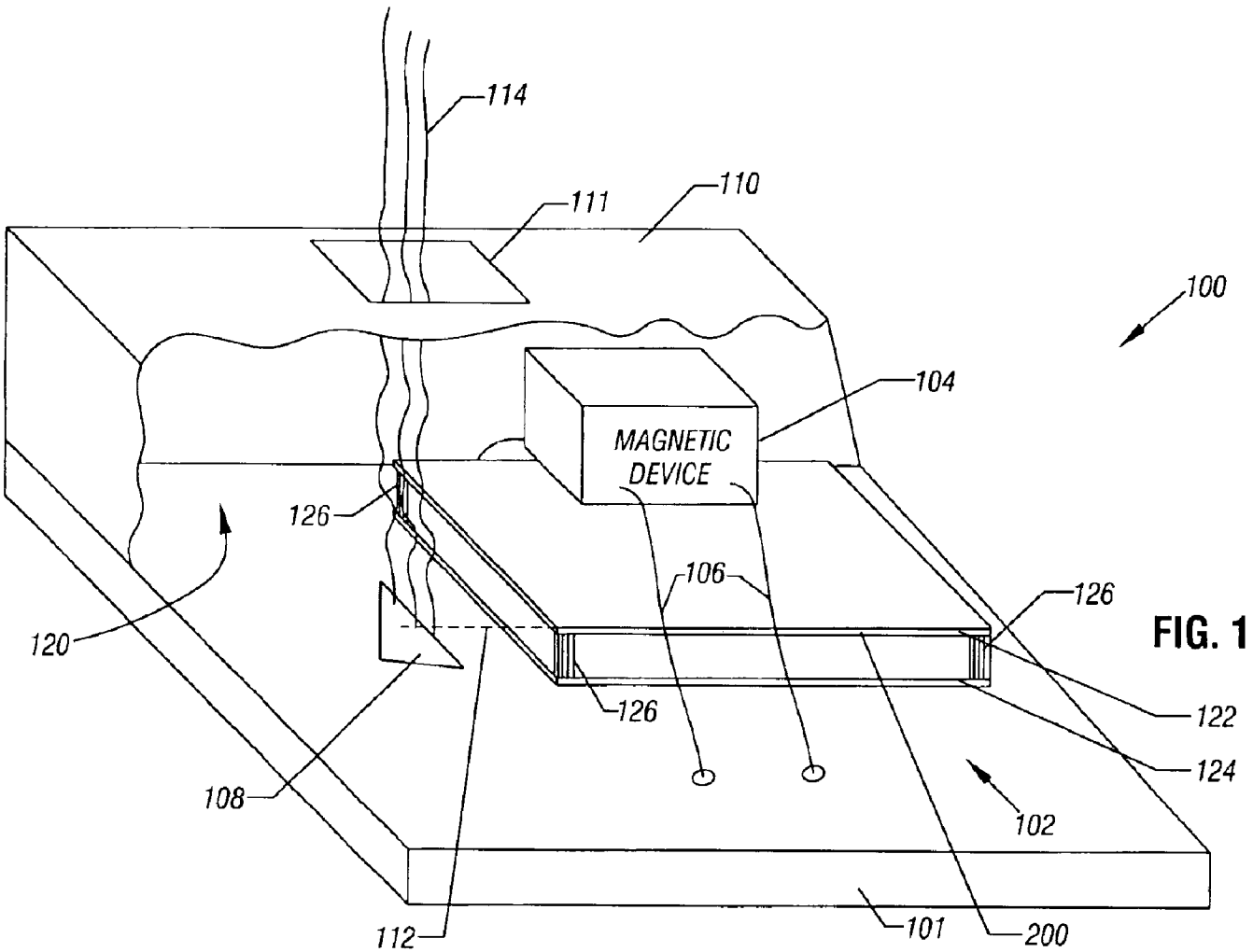
FIG. 1 illustrates a portion of an X-ray generating apparatus that includes an electron beam generator having two parallel semiconductor dies, in accordance with an embodiment.

FIG. 1 illustrates a portion of an X-ray generating apparatus 100 that has a support board 101 and an electron beam generator 102 according to an embodiment mounted on the support board 101. The electron beam generator 102 generates an output beam 112 of electrons. The electrons in the output beam 112 bombard a target 108. In response to the bombardment of electrons, the target 108 generates X-rays 114 that are radiated through a window 111 of a housing 110 of the electron beam generator 102. The inner chamber 120 of the housing 110 includes a vacuum. Note that a portion of the housing 110 has been cut away in the view of FIG. 1 to illustrate the components of the X-ray generating apparatus 100 inside the housing 110.

The target 108 may be formed of a number of different materials, such as tungsten, molybdenum, or any other material that generates X-rays in response to impact by electrons. An X-ray includes electromagnetic radiation having a short wavelength, usually less than 100 angstroms, that is produced by bombarding a target with fast electrons in a vacuum or by transition of atoms to lower energy states.

A magnetic device 104 is placed proximate the electron beam generator 102. In the illustrated implementation, the magnetic device 104 is held in position by magnet support structures 106. In the orientation of FIG. 1, the magnetic device 104 is positioned above the electron beam generator 102. However, in other embodiments, the magnetic device 104 can be placed in a different position with respect to the electron beam generator 102, such as below the electron-beam generator 102, on either side of the electron beam 102, or in any other position with respect to the electron-beam generator 102. The magnetic device 104 can be an electromagnet that generates a magnetic field in response to input electrical energy. Alternatively, the magnetic device 104 can be a permanent magnet.

The electron beam generator 102 includes two generally parallel semiconductor structures, which in one implementation includes two semiconductor dies 122 and 124. The semiconductor dies 122 and 124 are spaced apart from each other. The spacing between the semiconductor dies 122 and 124 are maintained by the use of support columns 126. In other implementations, other types of support mechanisms can be used to maintain the relative positions of the semiconductor dies 122 and 124. Although the electron beam generator 102 includes two semiconductor dies according to one embodiment, other embodiments can use one semiconductor die or more than two semiconductor dies.

Figure 2:
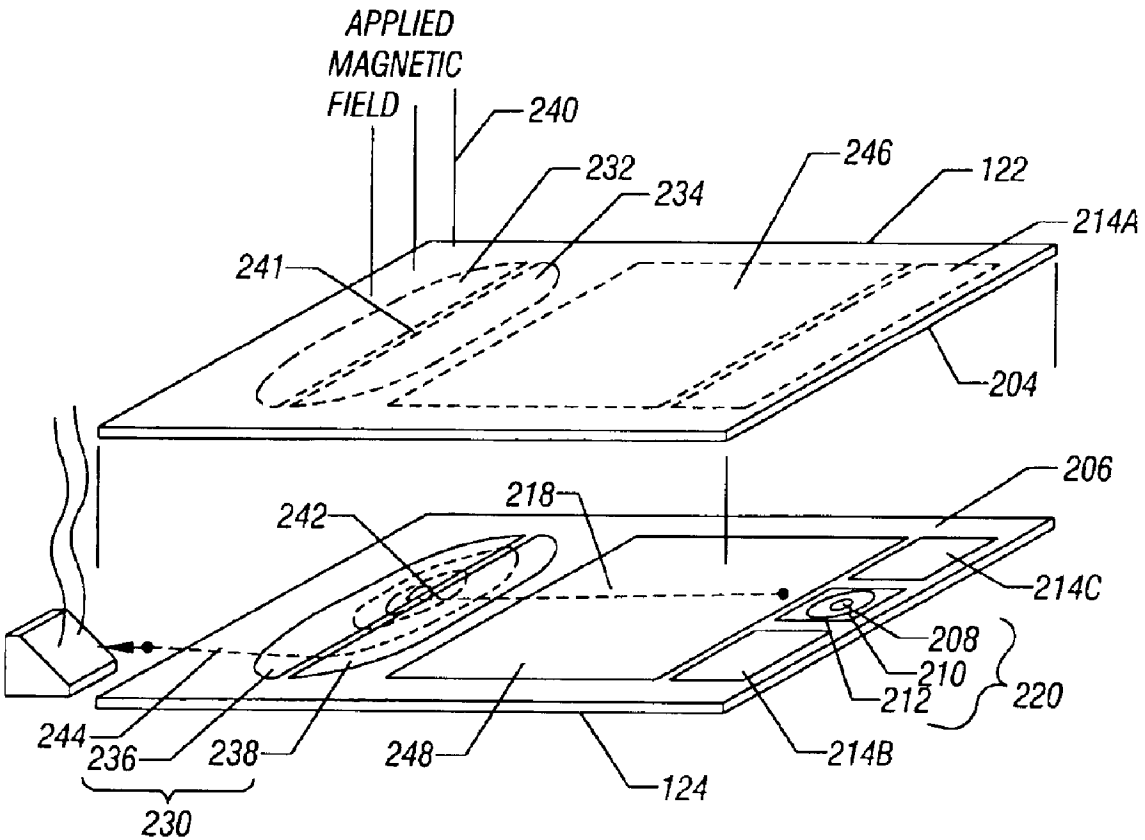
FIG. 2 illustrates paths of emitted electrons generated in the electron beam generator of FIG. 1, with the emitted electrons impacting a target to cause generation of X-rays from the target, in accordance with an embodiment.

As shown in greater detail in FIG. 2, the semiconductor dies 122 and 124 are arranged such that surfaces 204 and 206 of the dies 122 and 124, respectively, are parallel with respect to each other. A semiconductor-based field emitter 220 is formed on the surface 206 of the semiconductor die 124. The semiconductor-based field emitter 220 includes a cold cathode (also referred to as a field emission cathode). The field emitter 220 has associated electrodes that include a grid or extractor 208, a first lens element 210, and a second lens element 212. In other implementations, only one lens element or greater than two lens elements can be used.

The grid or extractor 208 extracts electrons by creating an electric field such that electrons tunnel through a potential barrier and are emitted from the semiconductor material that is part of the semiconductor die 124. The first lens element 210 acts both as a focusing element and as an aperture stop to limit the acceptance angle of an emitted beam of electrons. The second lens element 212 helps to collimate the beam of electrons extracted by the grid or extractor 208. Collimating electrons refers to making the emitted electrons travel in parallel paths. Thus, as used here, a "beam of electrons" or "electron beam" includes one or multiple paths through which electrons travel.

The electrodes associated with the semiconductor-based field emitter 220 are used to modestly accelerate the emitted beam of electrons to give the electrons an initial velocity. At the stage where the electrons are just emitted from the field emitter 220, the electrons possess relatively low energy. An electron deflection mechanism includes one or more deflector electrodes 214 (214A, 214B, and 214C illustrated) to deflect a path of the low energy electron beam so that the electrons are directed to travel in a plane that is generally parallel to the surfaces 204 and 206 of the semiconductor dies 122 and 124, respectively. In one embodiment, the electrodes 214A, 214B, and 214C are electrostatic electrodes that create an electric field to perform electrostatic deflection of the electrons. In an alternative embodiment, the deflecting mechanism includes magnetic elements to generate a magnetic field to deflect the path of the electron beam. The electrons are deflected by the deflecting mechanism to travel along paths generally indicated as 218. The paths 218 are generally at a non-zero angle (such as 90°) with respect to the original direction of the emitted electrons.

The electrons traveling along the paths 218 are directed towards an accelerator section 230. The accelerator section 230 includes an upper set of electrodes 232 and 234 (formed on the semiconductor die 122) and a lower set of electrodes 236 and 238 (formed on the lower semiconductor die 124). Each of the electrodes 232, 234, 236 and 238 are generally D-shaped electrodes. Alternating current (AC) signals are applied to the electrodes 232, 234, 236 and 238. In one implementation, the AC signals are generally square wave signals that alternate between a positive polarity and a negative polarity. Alternatively, the AC signals may be sinusoidal signals.

Within each set of electrodes, the AC signal applied to one of the electrode is out of phase (180° out of phase in one example) with respect to the other electrode in the set. Thus, for example, at a given point in time, if the AC signal applied at electrode 232 in the upper set is positive, then the AC signal applied at electrode 234 is negative (and vice versa). Similarly, in the lower set, if the AC signal applied at electrode 236 is positive, then the AC signal applied at electrode 238 is negative (and vice versa). As a result, an electric field is generated between electrodes 232 and 234, and an electric field is generated between electrodes 236 and 238.

In addition, a magnetic field 240 is also applied in a direction that is generally perpendicular to the surfaces 204 and 206 of respective semiconductor dies 122 and 124. The magnetic field 240 is applied by the magnet device 104 (FIG. 1). In the illustrated embodiment, the accelerator section 230 is a cyclotron. In other embodiments, other types of accelerators can be used.

In a cyclotron, a charged particle (in this case each of the electrons that are traveling along the paths 218) move in a generally curved path (indicated as 242) due to the presence of the magnetic field 240. The D-shaped electrodes 232, 234, 236, and 238, which are immersed in the magnetic field 240 and driven by AC excitation at a predetermined frequency, cause the electrons to receive a series of impulses that cause the electrons to gain energy with each cycle of the electric fields created by the electrodes 232, 234, 236, and 238. The result is a highly energetic stream of electrons that exit the edge of the magnetic field 240 along paths indicated generally as 244. The exiting electrons along paths 244 make up the electron beam 112 shown in FIG. 1.

The electric field provided to the grid or extractor 208 in the field emitter 220 is provided by one or both of electronic circuits 246 and 248 formed on respective semiconductor dies 122 and 124. The electronic circuits 246 and 248 also provide the AC signals to respective D-shaped electrodes 232, 234, 236, and 238.

The operating frequency of the cyclotron (that makes up the accelerator section 230 in one embodiment) is based at least in part on the desired or target kinetic energy of each electron. The operating frequency of the cyclotron is derived from a cyclotron equation based on various input parameters, including the kinetic energy (KE, expressed in keV or thousands of electron volts) of the electron, the charge of the electron (q), the rest mass ($m_0$) of the electron, the applied magnetic field (B), and the speed of light (c). Based on the input parameters, the operating frequency (f) is calculated as follows:

$$f=(q*B)/[\gamma*(2*\pi*m_0*10^9)],$$

where $$\gamma=[(KE*1.6*10^{-16})/m_0*c^2]+1.$$

The operating frequency (f) determines the frequency of the AC signals applied to the accelerator section 230.

Classically, this frequency (f) would have the constant value of $q*B/(2*\pi*m_0)$ (which is the non-relativistic cyclotron frequency). However, as the speed of the electrons grows beyond 1% of the speed of light or so, the apparent mass ($m_0*c^2$) also increases. As a result, either the frequency of the exciting electric field or the strength of the magnetic field discussed above must be adjusted accordingly so that the electrons will arrive at the gap between the pairs of electrodes (232, 234, 236, 238, in FIG. 2) in phase with the exciting electrical field. In the presence of a constant magnetic field 240 (FIG. 2), the electric field applied by the electrodes 232, 234, 236, 238 can be varied cyclically to produce bursts of electrons.

However, if the magnetic field 240 is varied radially according to the following relationship:

$$B(r)=B_0/\gamma=B_0\sqrt{(1-(f*2*\pi*r/c^2))},$$

where B is the magnetic field, r is the radius from a point 241 in FIG. 2, and $B_0$ is the non-relativistic cyclotron frequency, the electrons will remain in phase with the exciting electric field when the applied electric field maintains a constant frequency. The magnitude of the magnetic field B varies from the point 241 across a plane parallel to the surface of the semiconductor structure 122. In this case, the electrons will be emitted continuously, rather than in bursts.

Such contouring of the magnetic field B (r) may be done more efficiently with the structure depicted in FIG. 2 because of the structure's relatively small size. For example, magnetic field inducing coils formed on one or both of the semiconductor dies 122 and 124 using semiconductor fabrication processes may be placed in the proximity of the electrodes 233, 234, 236, 238. Such coils may be used to bias an external uniform magnetic field, or to produce the magnetic field in its entirety.

As noted above, the inner chamber 120 (FIG. 1) of the X-ray generating apparatus 100 includes a vacuum. The electrons emitted by the field emitter 220 and deflected by the deflecting mechanism travel in the vacuum along paths 218, 242, and 244. The vacuum is provided at the time of manufacture of the X-ray generating apparatus 100, and is maintained over the life of the X-ray generating apparatus by using getters (not shown). Getters are designed to remove contaminant gases inside the chamber 120 (FIG. 1) of the X-ray generating apparatus 100. The emitted electron beam may also be part of the getter device, since the electron beams tend to aid in removing contaminant gases.

Figure 3:
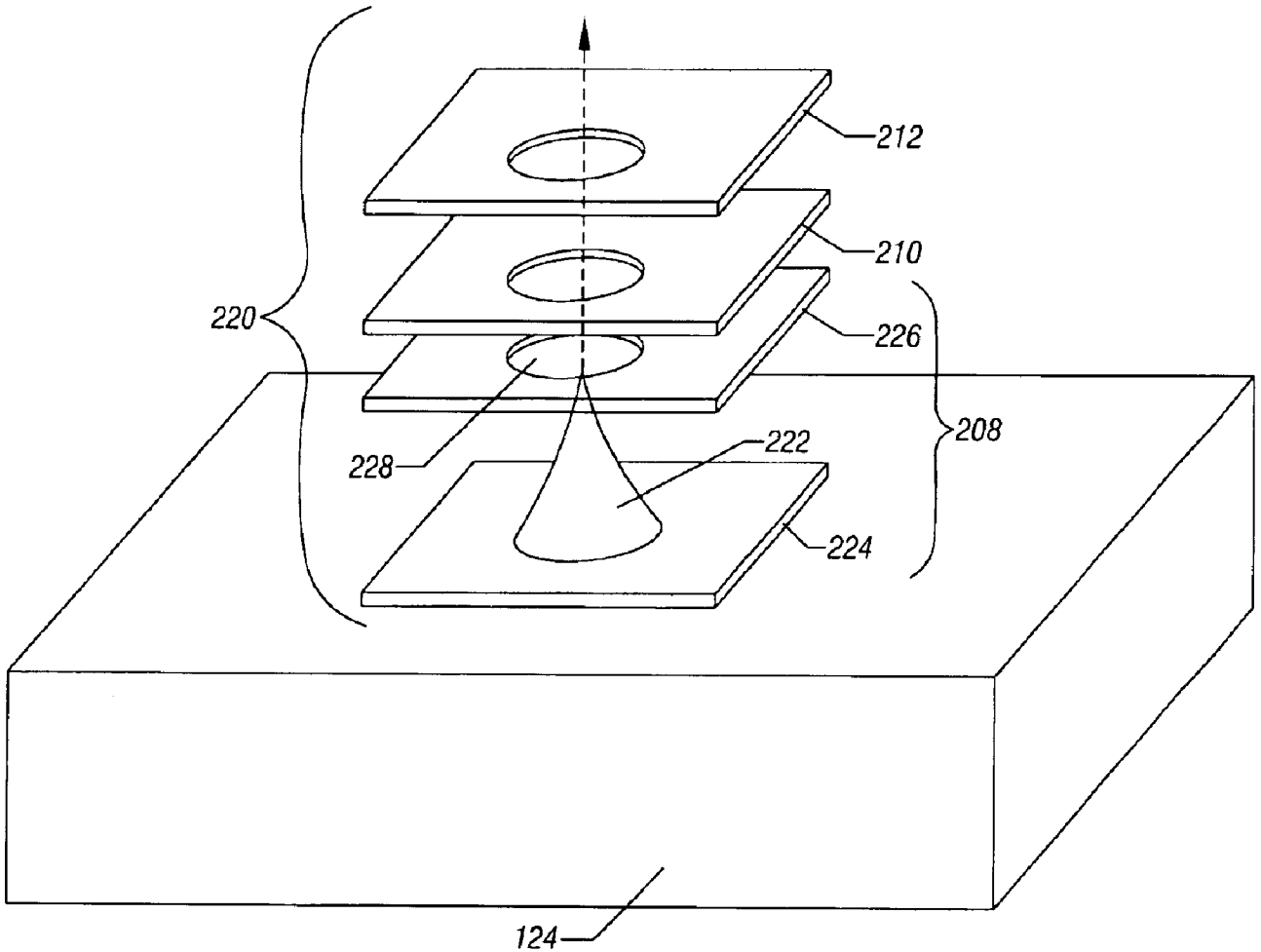
FIG. 3 illustrates a semiconductor-based cold cathode field emitter formed on one of the semiconductor dies in the electron beam generator of FIG. 1, in accordance with an embodiment.

FIG. 3 shows the semiconductor-based field emitter 220 (FIG. 2) in greater detail. A field emitter tip 222 rises to a sharp point from a cathode 224 formed in the semiconductor die 124. The field emitter tip 222 is formed of a semiconductor material, such as silicon and so forth. Alternatively, the field emitter tip 222 can be formed of a metal. The cathode 224 is electrically conductive, and can be formed of silicon, polysilicon, metal, or any other electrically conductive material. A localized electric field is applied in the vicinity of the field emitter tip 222 by an anode 226 that has an aperture 228 above and around the point of the field emitter tip 222. The electric field is produced between the cathode 224 and anode 226. The applied electric field causes electrons to escape from the sharp point of the field emitter tip 222 by quantum mechanical tunneling through a lowered potential energy barrier. Collectively, the field emitter 222, cathode 224, and anode 226 form the grid or extractor 208.

Because the X-ray generating apparatus 100 employs semiconductor technology, the X-ray generating apparatus 100 can be made much smaller than conventional X-ray sources (such as those that use X-ray tubes). The smaller size of the X-ray generating apparatus 100 makes it possible to use the X-ray generating apparatus 100 in small spaces, such as inside a human body, in tight spaces of machinery or other structures, and so forth. Also, the smaller size of the X-ray generating apparatus 100 means that it is lighter weight and can be made portable.

Additionally, by employing semiconductor technology, the X-ray generating apparatus 100 can be manufactured in a relatively cost-efficient manner. Also, use of semiconductor-based technology provides for high-speed circuitry that consumes relatively low power. The X-ray generating apparatus 100 is quicker to power on than conventional X-ray sources. Also, by using an accelerator section based on the cyclotron technology, large voltages that are used in conventional X-ray tubes do not have to be employed. The smaller voltages lead to reduced power consumption, as well as enhanced safety. By reducing power consumption, the X-ray generating apparatus 100 according to some implementations may even be operated from batteries.

In the foregoing description, numerous details are set forth to provide an understanding of the present invention. However, it will be understood by those skilled in the art that the present invention may be practiced without these details. While the invention has been disclosed with respect to a number of embodiments, those skilled in the art will appreciate numerous modifications and variations therefrom. It is intended that the appended claims cover such modifications and variations as fall within the true spirit and scope of the invention.

What is claimed is:

1. An X-ray generating apparatus, comprising:

first and second semiconductor structures, the first semiconductor structure spaced apart from the second semiconductor structure;

an emitter formed on the first semiconductor structure, the emitter to emit electrons that travel in a path in a space between the first and second semiconductor structures; and an element to generate X-rays in response to impact by the electrons on the element.

2. The X-ray generating apparatus of claim 1, further comprising a deflecting mechanism to deflect the electrons.

3. The X-ray generating apparatus of claim 2, wherein the deflecting mechanism has electrodes formed on the first and second semiconductor structures.

4. The X-ray generating apparatus of claim 2, wherein the path of the electrons comprises a first path, and wherein the deflecting mechanism is adapted to deflect the electrons from a second path to the first path, the first path being at a non-zero angle with respect to the second path.

5. The X-ray generating apparatus of claim 4, wherein the deflecting mechanism is adapted to generate an electric field to deflect the electrons.

6. The X-ray generating apparatus of claim 4, wherein the deflecting mechanism is adapted to generate a magnetic field to deflect the electrons.

7. The X-ray generating apparatus of claim 1, wherein the emitter comprises a field emitter.

8. The X-ray generating apparatus of claim 1, wherein the emitter comprises a pointed tip and elements to apply an electric field to cause emission of electrons from the pointed tip.

9. The X-ray generating apparatus of claim 8, wherein the emitter further comprises a lens element to focus the electrons emitted from the pointed tip.

10. The X-ray generating apparatus of claim 8, wherein the emitter further comprises a lens element to collimate the electrons emitted from the pointed tip.

11. The X-ray generating apparatus of claim 1, wherein the element is formed of a material containing tungsten.

12. The X-ray generating apparatus of claim 1, wherein the element is formed of a material containing molybdenum.

13. The X-ray generating apparatus of claim 1, wherein the emitter comprises a field emitter having an extractor to extract electrons by creating an electric field, the X-ray generating apparatus further comprising an electronic circuit formed on at least one of the first and second semiconductor structures to provide electrical energy to the extractor.

14. An X-ray generating apparatus, comprising:

a semiconductor structure;

an emitter formed on the semiconductor structure, the emitter to emit electrons;

an element to generate X-rays in response to impact by the electrons on the element; and an accelerator having electrodes formed on the semiconductor structure, the accelerator to accelerate the electrons.

15. The X-ray generating apparatus of claim 14, further comprising a magnetic device to apply a magnetic field to cause the electrons to travel in a curved path.

16. The X-ray generating apparatus of claim 15, wherein the accelerator is positioned to be immersed in the magnetic field.

17. The X-ray generating apparatus of claim 15, further comprising circuitry to apply alternating current (AC) signals to the electrodes.

18. The X-ray generating apparatus of claim 17, wherein the accelerator comprises a cyclotron.

19. The X-ray generating apparatus of claim 15, wherein the magnetic field varies radially along a direction in a plane parallel to a surface of the semiconductor structure.

20. The X-ray generating apparatus of claim 14, further comprising a second semiconductor structure and additional electrodes formed on the second semiconductor structure, the additional electrodes being part of the accelerator.

21. The X-ray generating apparatus of claim 20, wherein the semiconductor structures comprise semiconductor dies.

22. The X-ray generating apparatus of claim 20, wherein the semiconductor structures have respective surfaces that are generally parallel to each other, the X-ray generating apparatus further comprising a deflecting mechanism to deflect the electrons from a first path to a second path, the second path being generally parallel to the surfaces of the semiconductor structures.

23. A method of generating X-rays, comprising:

activating an emitter on a first semiconductor structure to emit electrons; and directing the electrons along a path between the first semiconductor structure and a second semiconductor structure onto a target to cause the target to generate X-rays, wherein directing the electrons comprises directing the electrons using a deflecting mechanism having electrodes on the first and second semiconductor structures.

24. The method of claim 23, wherein activating the emitter comprises generating an electric field to cause emission of electrons from a pointed tip in the emitter.

25. The method of claim 24, further comprising collimating the emitted electrons using a lens element.

26. The method of claim 23, further comprising deflecting the emitted electrons from a first path to a second path.

27. The method of claim 26, further comprising accelerating the electrons traveling in the second path to increase an energy of the electrons prior to impact of the electrons onto the target.

28. A method of generating X-rays, comprising:

activating an emitter on a semiconductor structure to emit electrons;

directing the electrons onto a target to cause the target to generate X-rays;

deflecting the emitted electrons from a first path to a second path; and accelerating the electrons traveling in the second path to increase an energy of the electrons prior to impact of the electrons onto the target, wherein accelerating the electrons comprises accelerating the electrons with an accelerator having electrodes formed on the semiconductor structure.

29. The method of claim 28, further comprising applying a magnetic field, the accelerator immersed in the magnetic field.

30. The method of claim 29, further comprising varying the magnetic field radially from a point on the semiconductor structure across a plane parallel to a surface of the semiconductor structure.

31. An X-ray source device, comprising:

a housing defining a chamber;

a semiconductor structure disposed in the chamber, the chamber containing a vacuum;

a field emitter formed on the semiconductor structure to emit electrons;

a target in the chamber to generate X-rays in response to impact by the electrons; and an accelerator having electrodes formed on the semiconductor structure, the accelerator to accelerate the electrons prior to impact on the target.

32. The X-ray source device of claim 31, further comprising a magnetic device to generate a magnetic field to cause the electrons to travel in a curved path as the electrons are accelerated by the accelerator.

33. An X-ray source device, comprising:

a housing defining a chamber;

at least two semiconductor structures disposed in the chamber, the chamber containing a vacuum, the at least two semiconductor structures being generally parallel to each other;

a field emitter formed on one of the at least two semiconductor structures to emit electrons;

a deflecting mechanism in the chamber to deflect the electrons from a first path to a second path, the second path extending along a space between the at least two semiconductor structures; and a target in the chamber to generate X-rays in response to impact by the electrons.

34. The X-ray source device of claim 33, wherein the second path is generally parallel to the at least two semiconductor structures.

35. The X-ray source device of claim 33, further comprising an accelerator having electrodes formed on at least one of the at least two semiconductor structures.

36. The X-ray source device of claim 33, wherein the at least two semiconductor structures are spaced apart from each other.

* * * * *